US012520907B2

(12) United States Patent
Chen

(10) Patent No.: US 12,520,907 B2
(45) Date of Patent: Jan. 13, 2026

(54) SHOE AND MANUFACTURING METHOD THEREOF

(71) Applicant: Amplifi Tech (Xiamen) Limited, Fujian (CN)

(72) Inventor: Li-Wei Chen, Taoyuan (TW)

(73) Assignee: Amplifi Tech (Xiamen) Limited, Xiamen (CN)

( * ) Notice: Subject to any disclaimer, the term of this patent is extended or adjusted under 35 U.S.C. 154(b) by 0 days.

(21) Appl. No.: 18/621,300

(22) Filed: Mar. 29, 2024

(65) Prior Publication Data

US 2024/0381975 A1 Nov. 21, 2024

(30) Foreign Application Priority Data

May 16, 2023 (CN) ..... 202310550165.5

(51) Int. Cl.
*A43B 23/02* (2006.01)
*A43B 3/24* (2006.01)
*A43D 86/00* (2006.01)

(52) U.S. Cl.
CPC ..... *A43B 23/0245* (2013.01); *A43B 3/244* (2013.01); *A43D 86/00* (2013.01)

(58) Field of Classification Search
CPC ..... A43B 3/122; A43B 3/128; A43B 3/14; A43B 3/244; A43B 23/0245
See application file for complete search history.

(56) References Cited

U.S. PATENT DOCUMENTS

| | | | | |
|---|---|---|---|---|
| 2,126,094 | A * | 8/1938 | Daniels | A43B 3/122 D2/918 |
| 10,874,172 | B2 | 12/2020 | Corcoran-Tadd et al. | |
| 10,925,344 | B1 * | 2/2021 | Fina | A43B 3/126 |
| 2016/0120258 | A1 * | 5/2016 | Azulay | A43B 3/122 12/146 B |
| 2016/0206044 | A1 * | 7/2016 | Dimoff | A43C 1/04 |
| 2016/0242493 | A1 * | 8/2016 | Stillwagon | A43C 5/00 |
| 2016/0242503 | A1 * | 8/2016 | Waatti | A43B 23/0245 |
| 2019/0116936 | A1 * | 4/2019 | Aceves Tinajero | A43B 9/00 |
| 2019/0297988 | A1 * | 10/2019 | Oden | A43B 3/244 |
| 2020/0154816 | A1 * | 5/2020 | Gaba | A43C 1/04 |
| 2021/0100316 | A1 * | 4/2021 | Corcoran-Tadd | B32B 5/26 |

(Continued)

FOREIGN PATENT DOCUMENTS

| | | | |
|---|---|---|---|
| CN | 1526338 A | 9/2004 | |
| EP | 2548463 A2 * | 1/2013 | A43B 3/103 |

(Continued)

*Primary Examiner* — Megan E Lynch
(74) *Attorney, Agent, or Firm* — Cooper Legal Group, LLC

(57) ABSTRACT

The present disclosure provides a shoe, comprising: a shoe sole having a bottom surface, a sidewall surface, and a top surface opposite to the bottom surface; a plurality of positioning structures disposed on the perimeter of the sidewall surface; and a foot covering part comprising at least one thread, in which each thread extends from one of the positioning structures to another positioning structure to form a thread extension part, and the collection of a plurality of thread extension parts forms a configuration that fits a user's foot. The present disclosure also provides a manufacturing method of a shoe. The foot covering part of the shoe of the present disclosure comprises one or a plurality of threads.

17 Claims, 8 Drawing Sheets

(56) References Cited

U.S. PATENT DOCUMENTS

| | | | | |
|---|---|---|---|---|
| 2021/0195986 | A1* | 7/2021 | Fina | A43B 3/122 |
| 2022/0104588 | A1* | 4/2022 | Zinner | A43D 11/02 |
| 2023/0081164 | A1* | 3/2023 | Byun | B32B 5/024<br>442/269 |
| 2024/0260704 | A1* | 8/2024 | Fina | A43B 3/244 |

FOREIGN PATENT DOCUMENTS

| | | | | |
|---|---|---|---|---|
| FR | 1198306 | A * | 12/1959 | |
| WO | WO-2008117270 | A2 * | 10/2008 | A43B 13/14 |
| WO | WO-2011051984 | A1 * | 5/2011 | A43B 1/0027 |

* cited by examiner

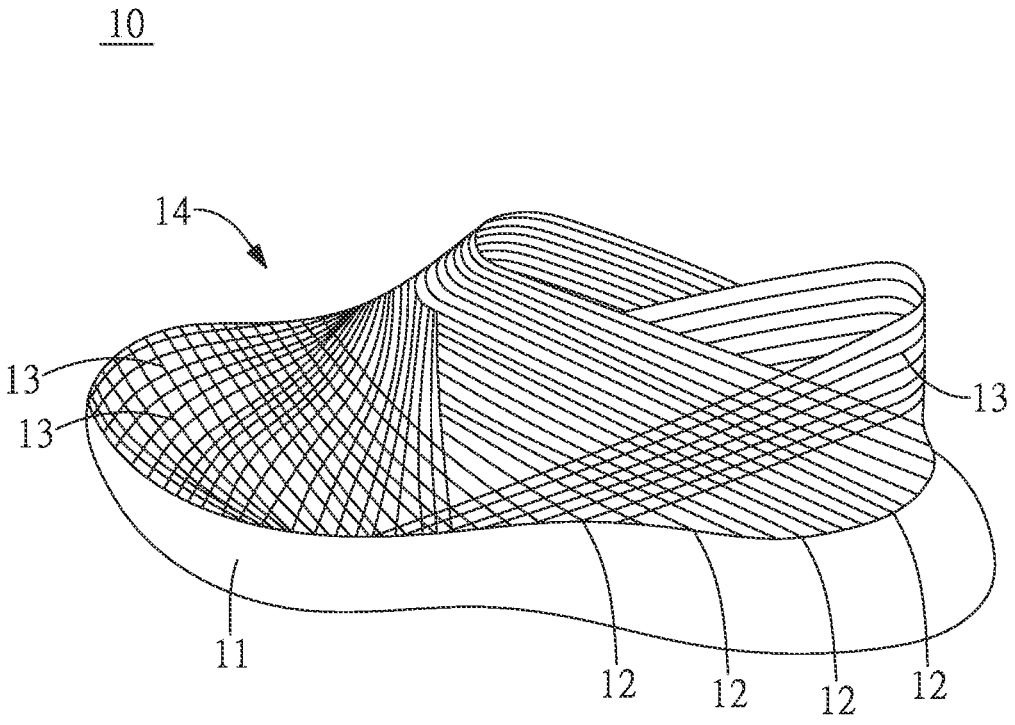
【Figure 1】

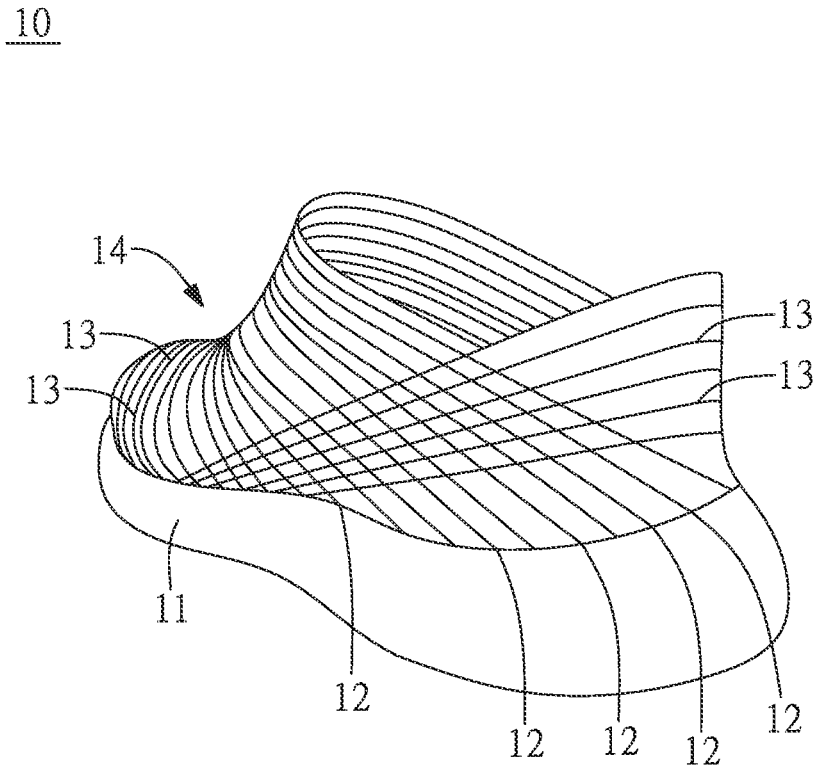
【Figure 2】

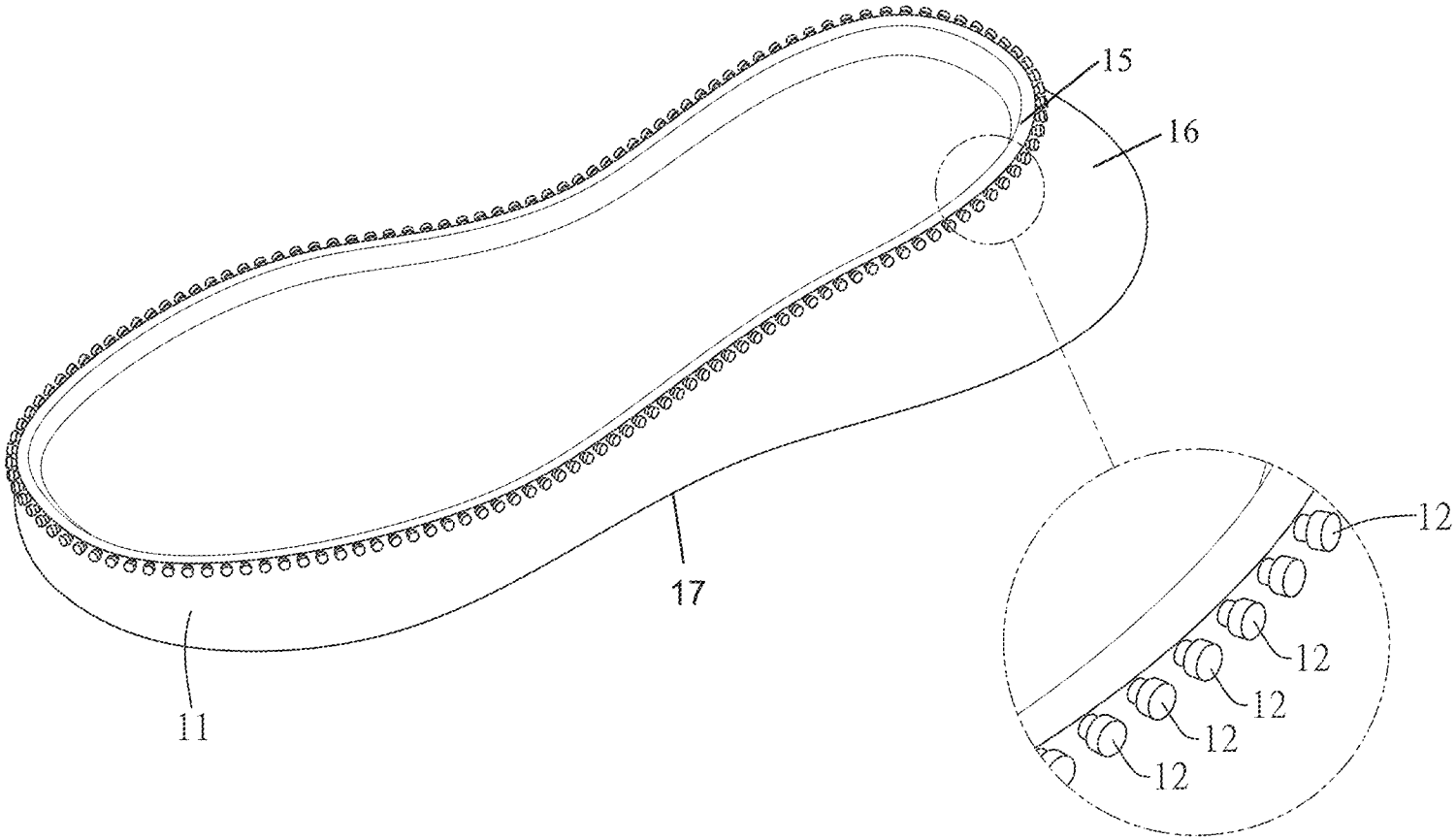
【Figure 3】

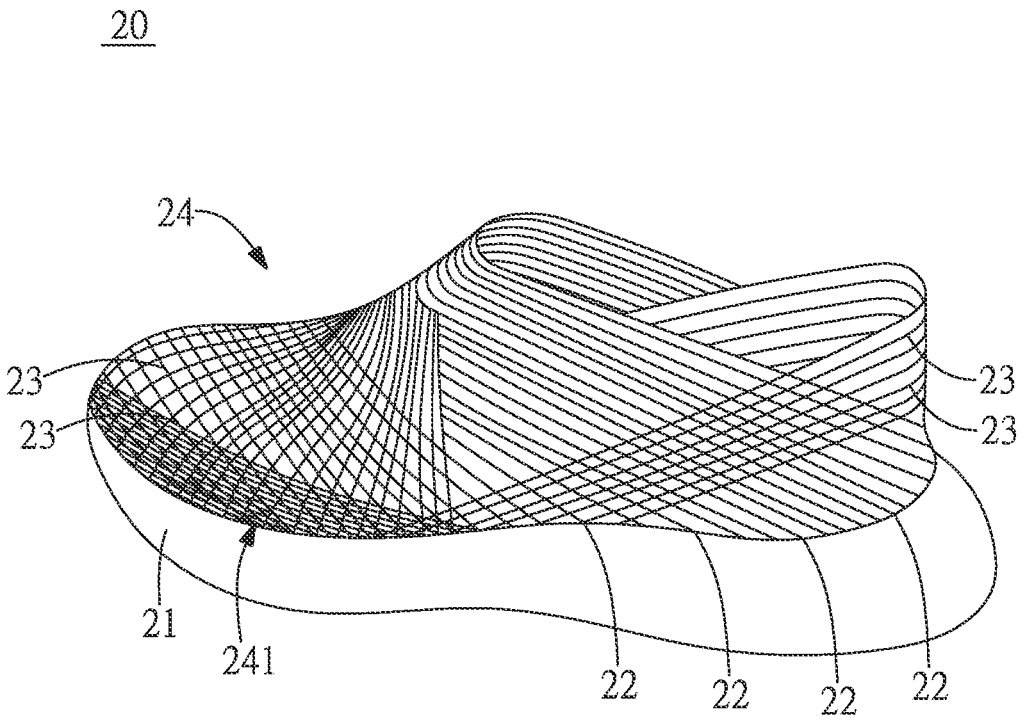
【Figure 4】

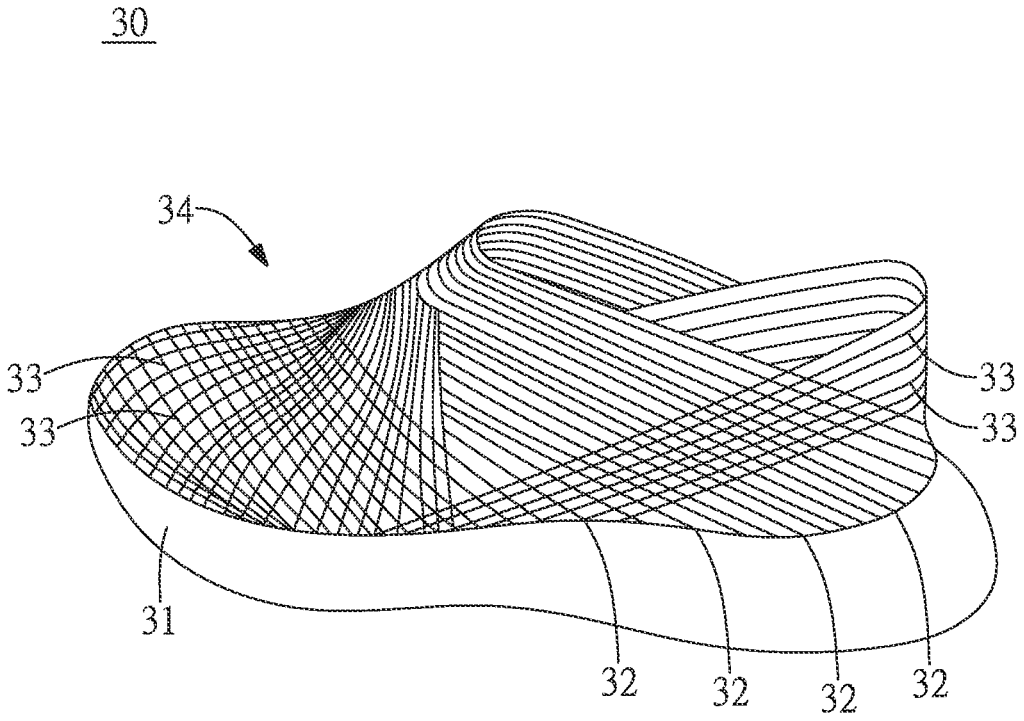
【Figure 5】

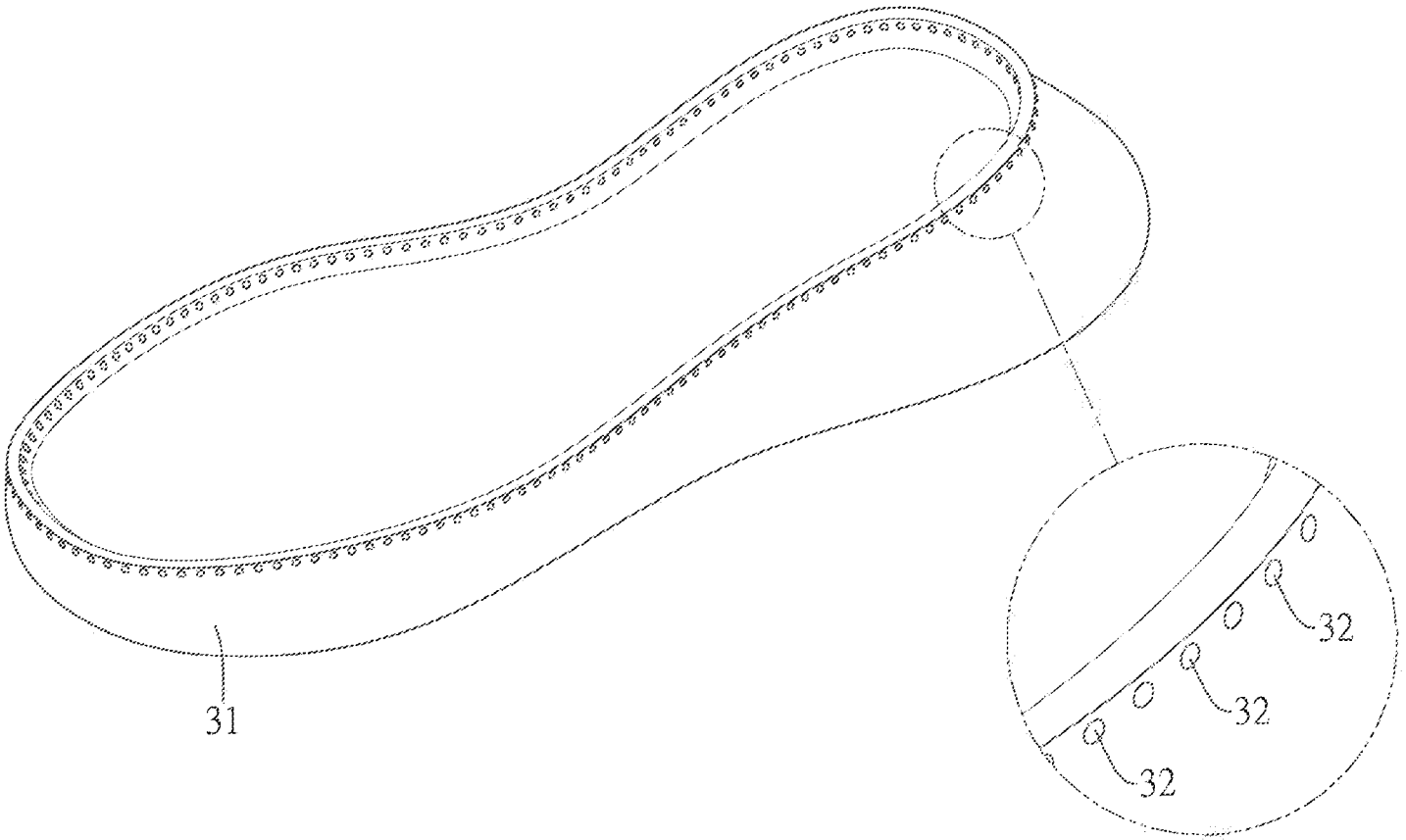
[Figure 6]

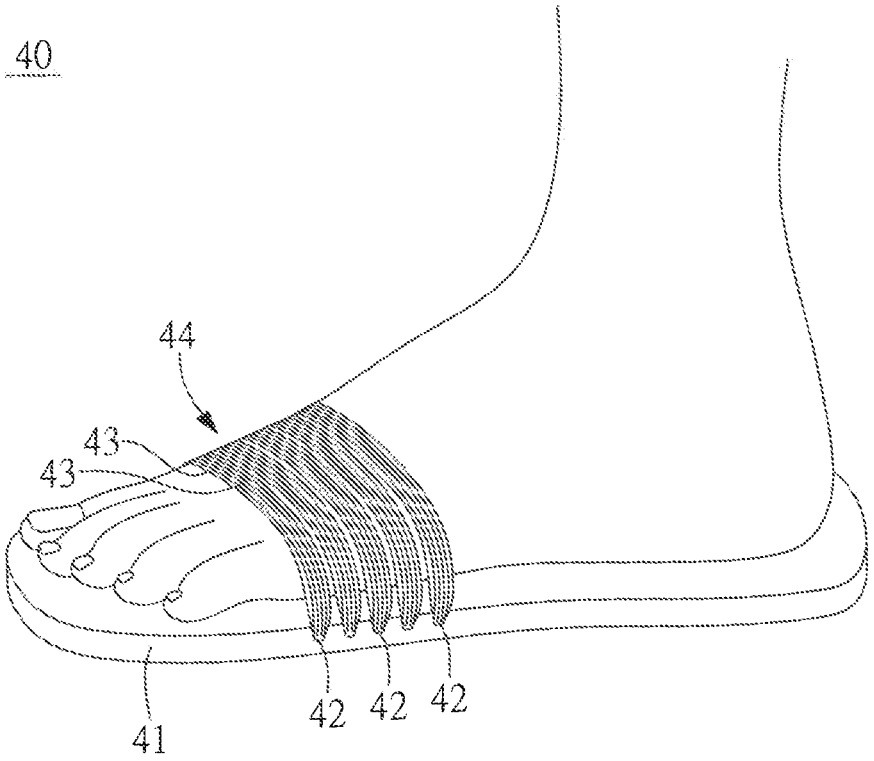
【Figure 7】

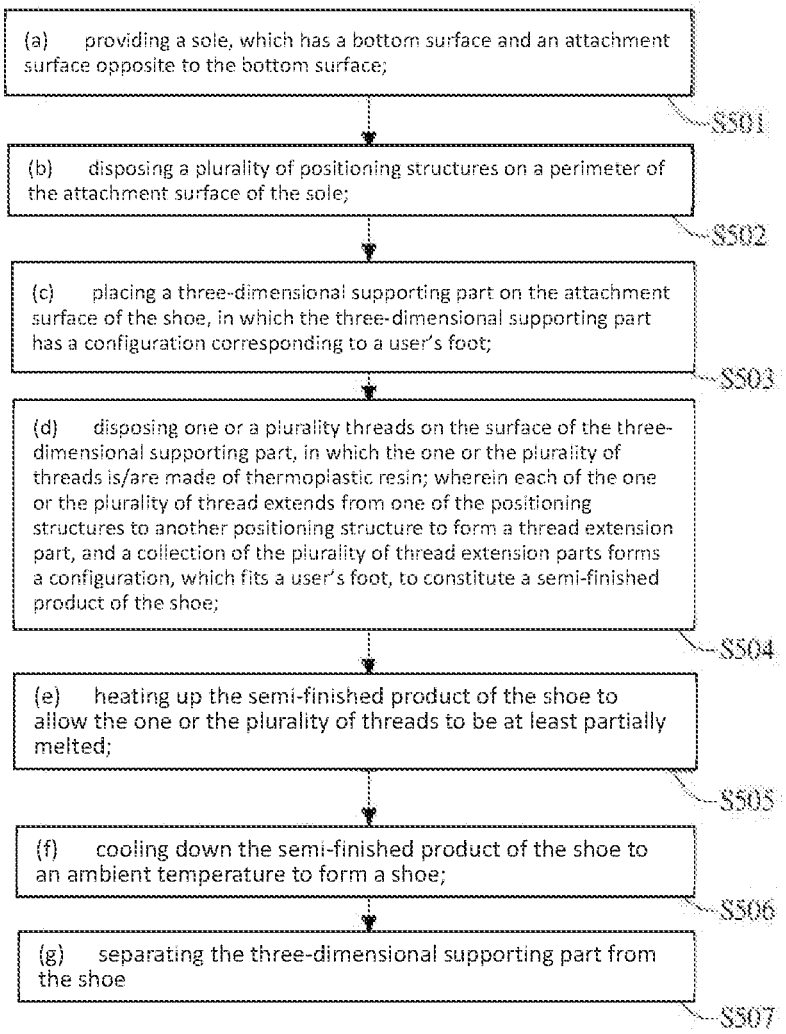
【Figure 8】

SHOE AND MANUFACTURING METHOD THEREOF

CROSS-REFERENCE TO RELATED APPLICATION

This application claims priority to Chinese Patent Application 202310550165.5, filed May 16, 2023, which is incorporated herein by reference.

FIELD OF DISCLOSURE

The present disclosure relates to a shoe, more specifically, a shoe having a glueless bonding between an upper portion and a sole. The upper portion is made directly on the perimeter of the sole by winding threads around the positioning structures multiple times, wherein the positioning structures are mounted on the perimeter of the shoe sole. The upper portion defines a space, which accommodates a user's foot. The present disclosure also relates to a manufacturing method, which produces an upper portion by directly winding threads on the perimeter of the sole.

DESCRIPTION OF RELATED ART

Traditionally, shoes are assembled by bonding multiple parts, primarily through using adhesives. However, in a production process using adhesives, vast amounts of volatile organic gas is generated, which affects health of operating personnel and is not environmentally friendly. That is why there is a need to find a green bonding method for shoes.

US Patent No. US20210100316A1 discloses breathable footwear with a woven upper portion, which comprises a sole and an upper portion coupled to the sole, wherein the upper portion comprises a plurality of thread line groups, which are wound around a plurality of anchor points; the plurality of anchor points are disposed at the locations between the perimeter of the upper portion and the interior of the upper portion. Different from the present disclosure, the anchor points of US Patent Application No. US20210100316A1 are disposed on an area of the upper portion, which can be the periphery or the central areas of the upper portion (please refer to paragraph [0056] and FIG. 4A, FIG. 4B of US Patent Application No. US20210100316A1).

U.S. Pat. No. 10,874,172B2 discloses a methods of weaving an upper portion, which includes: defining a plurality of peripheral anchor points by pins coupled to a support plate; winding a continuous thread around the plurality of peripheral anchor points to form a thread pattern, wherein the continuous thread comprises a plurality of thread lines, in which each thread line extends between two respective peripheral anchor points. After bonding the plurality of thread lines, the support plate is removed. Different from the present disclosure, the anchor points of U.S. Pat. No. 10,874,172B2 are disposed on the upper portion (please refer to the descriptions in Column 1, paragraph 6 and Column 27, paragraph 3). As the upper portion has been manufactured, the upper portion is coupled with the sole at the biteline area.

SUMMARY

In view of the aforementioned problems of shoes and manufacturing methods thereof in the prior art, the present disclosure provides a shoe and the manufacturing method thereof, which manufactures an upper portion directly on the perimeter of the sole by producing positioning structures around the perimeter of the sole in a seamlessly integrated manner through 3D printing and winding the thread around the positioning structures multiple times. Shoes made by the aforementioned method need no adhesives to bond the sole and the upper portion. The shoe and the manufacturing method thereof disclosed in the present disclosure prevents the processes of purchasing, manufacturing, processing, shipping, and assembling multiple parts and reduces carbon footprint effectively; therefore, a green and low-carbon product can be achieved through this energy-saving and environmentally friendly process.

In order to achieve the aforementioned purposes and other objectives, the present disclosure provides a shoe, comprising:

- a sole having a bottom surface, a sidewall surface, and a top surface opposite to the bottom surface;
- a plurality of positioning structures disposed on a perimeter of the sidewall surface; and
- a foot covering part comprising at least one thread, in which each of the at least one thread extends from a first one of the plurality of positioning structures to a second one of the plurality of positioning structure to form a thread extension part, and a collection of a plurality of the thread extension parts forms a configuration that fits a foot of a user,
- wherein the sole and the foot covering part define a space suitable to accommodate and retain the foot while the user is walking or doing exercises.

In the aforementioned shoe, the foot covering part of the shoe constitutes an upper portion of the shoe.

In the aforementioned shoe, the at least one thread can be wound additional times to form a higher thread density around areas of the foot containing part, where mechanical strength or wear resistance properties are desired. The higher thread density refers to having a larger number of threads or passing per unit area.

In the aforementioned shoe, the at least one thread can be wound additional times to increase a strength of the upper portion by creating a higher thread density around the toe box of the shoe.

In the aforementioned shoe, the at least one thread can be wound additional times to increase a strength of the upper portion by creating a higher thread density around the heel counter of the shoe.

In the aforementioned shoe, the plurality of positioning structures of the shoe can be a plurality of protruding pin-like elements.

In the aforementioned shoe, the plurality of protruding pin-like elements have a head with a diameter, which can be 1.8-2.2 mm, and with a thickness, which can be 1.3-2 mm; and the plurality of protruding pin-like elements can have an extending portion with a diameter, which can be 1-1.3 mm, and with a length, which can be 1.3-2 mm, wherein the extending portion extends from the head to the sole. The diameter of the head of the protruding pin-like elements and the diameter of the extending portion of the protruding pin-like elements, which extends from the head to sole, can have a diameter ratio of 1.3-2.2.

In the aforementioned shoe, the plurality of positioning structures can be a plurality of holes.

In the aforementioned shoe, the at least one thread can be wound around only a certain subset of the plurality of positioning structures; i.e., some of the plurality of positioning structures are not wound with threads. One or more of the plurality of threads may extend from one of the positioning structures to another positioning structure, to build a collection of a plurality of thread extension parts to form a foot covering part. The sole and the foot covering part define a space suitable for accommodating a user's foot and retaining the user's foot therewithin while the user is walking or doing exercises;

In the aforementioned shoe, the thread extension parts of the foot covering part can at least partially be bonded together.

In the aforementioned shoe, at least a part of the thread extension parts can be connected to each other at the plurality of positioning structures; in other words, the foot covering part can be made by a single thread.

In order to achieve the aforementioned purposes and other objectives, the present disclosure provides a manufacturing method of a shoe, comprising the following steps:

(a) providing a sole having a bottom surface, a sidewall surface, and a top surface opposite to the bottom surface;

(b) disposing a plurality of positioning structures on a perimeter of the sidewall surface of the sole;

(c) placing a three-dimensional supporting part on the sidewall surface of the shoe, wherein the three-dimensional supporting part has a configuration corresponding to a foot of a user;

(d) disposing at least one thread on a surface of the three-dimensional supporting part, wherein the at least one thread is made of thermoplastic resin, each of the at least one threads extends from a first one of the plurality of positioning structures to a second one of the plurality of positioning structures to form the thread extension part, and a collection of a plurality of the thread extension parts forms a configuration that fits a foot of a user to constitute a semi-finished product of the shoe;

(e) heating up the semi-finished product of the shoe to allow the at least one thread to be at least partially melted;

(f) cooling down the semi-finished product of the shoe to form a shoe; and (g) separating the three-dimensional supporting part from the shoe, wherein, the at least one thread forms a foot covering part, and the sole and the foot covering part define a space suitable to accommodate and retain the foot therewithin while the user is walking or doing exercises.

In the aforementioned manufacturing method, the sole and the positioning structures can be formed by a seamlessly integrated process;

In the aforementioned manufacturing method, the at least one thread can be heated up to a temperature of 100-210° C. in the step (e);

In the aforementioned manufacturing method, the one or the plurality of threads can be heated for 1-2 hours;

In the aforementioned manufacturing method, between the Step (d) and the Step (e), further comprising:

(d-1) placing the three-dimensional supporting part and the semi-finished product of the shoe into a sealed bag;

(d-2) extracting air from the sealed bag to allow the sealed bag to substantially cling to a surface of the semi-finished product of the shoe; and between Step (f) and Step (g), further comprising:

(f-1) removing the three-dimensional supporting part and the shoe from the sealed bag.

The shoe of the present disclosure is constituted by a foot covering part which made by one or a plurality of threads, and the manufacturing method thereof requires fewer processing steps, which makes the manufacturing method simpler and eliminates the need for adhesives.

BRIEF DESCRIPTION OF THE DRA WINGS

To better understand clearer and more detailed descriptions, the dimensions or sizes displayed in the figures and exemplary embodiments may be enlarged, simplified, or generalized, without necessarily implying the actual sizes and precise configurations of each element.

FIG. 1 is a schematic view of the shoe body of Embodiment 1 of the present disclosure;

FIG. 2 is a schematic view of the shoe body of Embodiment 1 of the present disclosure from a different angle;

FIG. 3 is a schematic view of the sole of the shoe of Embodiment 1 of the present disclosure;

FIG. 4 is a schematic view of the shoe of Embodiment 2 of the present disclosure;

FIG. 5 is a schematic view of the shoe of Embodiment 3 of the present disclosure;

FIG. 6 is a schematic view of the sole of the shoe of Embodiment 3 of the present disclosure;

FIG. 7 is a schematic view of the shoe of Embodiment 4 of the present disclosure; and FIG. 8 is a flow chart of the manufacturing method for the shoe of Embodiment 5 of the present disclosure.

DETAILED DESCRIPTION

Embodiment 1

Please refer to FIG. 1 to FIG. 3, in which FIG. 1 is a schematic view of the shoe of Embodiment 1 of the present disclosure; FIG. 2 is a schematic view of the shoe of Embodiment 1 of the present disclosure from a different perspective; FIG. 3 is a schematic view of the sole of the shoe of Embodiment 1 of the present disclosure. As shown in FIG. 1 to FIG. 3, the shoe 10 of Embodiment 1 comprises a sole 11, a plurality of positioning structures 12, a plurality of thread extension parts 13, and an upper portion 14 of the shoe 10 that is formed by a collection of the plurality of thread extension parts 13.

As shown in the figures, the sole 11 has a bottom surface 17, a sidewall surface 16, and a top surface 15 opposite to the bottom surface 17.

As shown in the figures, the positioning structures 12 are disposed on the perimeter of the sidewall surface 16.

In the embodiment, the sole 11 and the positioning structures 12 are formed in a seamlessly integrated manner by three-dimensional (3D) printing. The positioning structures 12 are, but not limited to, a plurality of protruding pin-like elements. A person skilled in the art can manufacture the sole 11 and the plurality of positioning structures 12 of the present disclosure in a seamlessly integrated manner or manufacture them separately by other known technologies. The plurality of positioning structures 12 are not limited to specific configurations; for example, in Embodiment 3 of the following content, the positioning structures 32 can be a plurality of holes. In the embodiment, the protruding pin-like elements have a head with a diameter of 1.8 mm and a thickness of 1 mm, and an extending portion of each of the protruding pin-like elements, which extends from the head to the sole 11, has a diameter of 1 mm and a length of 2 mm; but the present disclosure is not limited to the embodiment. In another preferred embodiment, the protruding pin-like elements have a head with a diameter of 2.2 mm and a thickness of 1 mm and the extending portion of each of the protruding pin-like elements, which extends from the head to the sole 11, has a diameter of 1.3 mm and a length of 1.3 mm.

As shown in figures, each thread extension part 13 extends from one of the positioning structures 12 to another positioning structure 12.

In the embodiment, the thread extension parts 13 are made of thermoplastic polyurethane (TPU) thread. In the embodiment, the threads are purchased from, San Fang Chemical Industry Co., Ltd., but not limited to the particular sources. A person in the art can optionally choose any other known threads which comprise thermoplastic resin, for example, threads can be commercially available Model No. UHF-300, UHF-600 (R) or UHF-200 from San Fang Chemical Industry Co., Ltd. In the embodiment, threads have a fineness of 150D-1500D; however, the fineness of the thread is not limited to any specific configurations, as long as the thread can properly be wound around the protruding pin-like elements. Preferably, the thread is selected to have a proper fineness that suits the size of the protruding pin-like elements in order to be wound around each of the protruding pin-like elements for 1 to 4 times.

In the embodiment, the thread extension parts 13 constitute the upper portion 14 of the shoe 10, in which a thread extends from one of the positioning structures 12 to another positioning structure 12 to form a thread extension part 13, and the collection of a plurality of thread extension parts 13 forms a configuration that fits a user's foot. The sole 11 and the upper portion 14 define a space, which is suitable to accommodate and retain the user's foot therewithin while the user is walking or doing exercises, but the present disclosure is not limited to the embodiment. In the shoe of the present disclosure, the foot covering part formed by one or a plurality of threads is not limited to any specific configuration, provided that the at least a foot covering part, with the sole 11, define a space which is suitable for accommodating and retaining a user's foot. For example, in the Embodiment 4 described below, a plurality of threads constitutes a strap foot covering part traversing the sidewall surface, which is configured to fit the user's foot bridge. In another embodiment, a plurality of threads constitutes a mesh foot covering part traversing the sidewall surface.

In the embodiment, the plurality of thread extension parts 13 are interlaced with each other, to form an upper portion 14. The thread extension parts 13 are at least partially bonded to each other at the intersection area to reinforce the upper portion 14 structure, but the present disclosure is not limited to this embodiment. In another embodiment, a plurality of thread extension parts are not bonded to each other.

In the embodiment, the plurality of thread extension parts 13 are connected to each other at the positioning structures 12, in which the plurality of thread extension parts 13, which constitute the toe box and the heel counter of the upper portion 14, are derived from one thread. In other words, the upper portion 14 is made of a single thread in this embodiment. In terms of the manufacturing method for the shoe 10, the thread is firstly immobilized on a positioning structure 12 (in this embodiment, the positioning structure 12 is a protruding pin-like element). The thread then extends from the initial positioning structure 12 to another positioning structure 12, where the thread winds around the latter positioning structure 12. Afterwards, the thread extends from the latter positioning structure 12 to yet another positioning structure 12, where the thread winds around. By repeating the aforementioned process, the thread weaves the toe box and the heel counter of the upper portion 14. Through this method, the manufacturing efficiency is improved. However, the present disclosure is not limited to the abovementioned embodiments. In another embodiment, the upper portion 14 is constituted of a plurality of threads, in which the plurality of threads are not connected to each other at the positioning structures 12.

Embodiment 2

Please refer to FIG. 4, which is a schematic view of the shoe of Embodiment 2 of the present disclosure.

The shoe 20 of the embodiment is similar to that of Embodiment 1, comprising a sole 21, a plurality of positioning structures 22, a plurality of thread extension parts 23, and an upper portion 24 of the shoe 20 that is formed by a collection of the plurality of thread extension parts 23.

The corresponding features of the embodiment and Embodiment 1 will not be repeated here again.

In comparison to Embodiment 1, the shoe 20 of Embodiment 2 has the thread extension part 23 made of a single thread, and the thread is wound more times around the toe box 241 to enhance the strength of upper portion 24 by creating a higher density of threads. This further enhances the durability of the upper portion 24. However, the present disclosure is not limited to the abovementioned embodiment. In another embodiment, one or a plurality of threads is/are wound more times around the heel counter to increase the strength of the upper portion 24 by creating a higher thread density. In another embodiment, one or a plurality of threads is/are wound more times around the toe box and the heel counter to increase the strength of the upper portion 24 by creating a higher density of threads.

Embodiment 3

Please refer to FIG. 5 and FIG. 6, in which FIG. 5 is a schematic view of the shoe of Embodiment 3 of the present disclosure; FIG. 6 is a schematic view of the sole of the shoe of Embodiment 3 of the present disclosure.

The shoe 30 of the embodiment is similar to that of Embodiment 1, comprising a sole 31, a plurality of positioning structures 32, a plurality of thread extension parts 33, and an upper portion 34 of the shoe 30 that is constituted by a collection of the plurality of thread extension parts 33.

The corresponding features of the embodiment and Embodiment 1 will not be repeated here again.

In comparison to Embodiment 1, the positioning structures 32 of the shoe 30 of the embodiment are a plurality of holes.

Similar to those described in Embodiment 1, in this embodiment, the thread extension parts 33 are connected to each other at the positioning structures 32, in which the plurality of thread extension parts 33, which constitute the toe box and the heel counter of the upper portion 34, are derived from one thread. In other words, the upper portion 34 is made of a single thread in this embodiment. In terms of the manufacturing method for the shoe 30, the thread is firstly immobilized on a positioning structure 32 (in this embodiment, the positioning structure 32 is a hole). The thread extends from the initial positioning structure 32 to another positioning structure 32, where the thread passes through the latter positioning structure 32. Afterwards, the thread extends from the latter positioning structure 32 to yet another positioning structure 32, where the thread passes through. By repeating the aforementioned process, the thread weaves the toe box and the heel counter of the upper portion 34. Through this method, the manufacturing efficiency can be improved. However, the present disclosure is not limited to the abovementioned described embodiments. In another embodiment, the upper portion 34 is constituted of a plurality of threads, in which the plurality of threads may not be connected to each other at the positioning structures 32.

Embodiment 4

Please refer to FIG. 7, which is a schematic view of the shoe of Embodiment 4 of the present disclosure.

The shoe 40 of the embodiment is similar to that of Embodiment 1, comprising a sole 41, a plurality of positioning structures 42, and a plurality of thread extension parts 43. The thread extension parts 43 constitutes the strap foot covering part 44 of the shoe 40.

The corresponding features of the embodiment and Embodiment 1 will not be repeated here again.

In comparison to Embodiment 1, the shoe 40 of Embodiment 4 has the positioning structures 42 that are only disposed on a part of the perimeter of the sidewall surface.

In comparison to Embodiment 1, the thread extension part 43 of the shoe 40 of Embodiment 4 constitutes the strap foot covering part 44, achieving the desired breathability and aesthetic effect. However, the present disclosure is not limited to the abovementioned embodiment. In another embodiment, the plurality of thread extension parts 43 can constitute more than one strap foot covering part. In another embodiment, the plurality of thread extension parts 43 can constitute a mesh foot covering part.

In the embodiment, the foot covering part 44 is constituted of a plurality of threads, in which the plurality of thread extension parts 43 are not connected to each other at the positioning structures 42.

Embodiment 5

Please refer to FIG. 8, which is a flow chart of the manufacturing method for the shoe of Embodiment 5 of the present disclosure.

As shown in FIG. 8, the shoe manufacturing method of the embodiment of the present disclosure comprises the following steps: (a) Step S501, providing a sole, having a bottom surface, a sidewall surface, and a top surface opposite to the bottom surface; (b) Step S502, disposing a plurality of positioning structures on a perimeter of the sidewall surface of the sole; (c) Step S503, placing a three-dimensional supporting part on the sidewall surface of the sole, wherein the three-dimensional supporting part has a configuration corresponding to a user's foot; (d) Step S504, disposing one or a plurality of threads on the surface of the three-dimensional supporting part, in which the one or the plurality of threads is/are made of thermoplastic resin; each of the one or the plurality of thread extends from one of the positioning structures to another positioning structure, to form a thread extension part, and a collection of the plurality of thread extension parts forms a configuration, which fits a user's foot, constituting a semi-finished product of the shoe; (e) Step S505, heating up the semi-finished product of the shoe to allow the one or the plurality of threads to be at least partially melted; (f) Step S506, cooling down the semi-finished product of the shoe to an ambient temperature in order to form a shoe; and (g) Step S507, separating the three-dimensional supporting part from the shoe. Among these steps, the one or the plurality of threads constitute(s) a foot covering part, and the sole and the foot covering part define a space, which is suitable to accommodate and retain a user's foot while the user is walking or doing exercises.

In the embodiment, the sole and the plurality of positioning structures in Step (a) and Step (b) are formed by a seamlessly integrated process through 3D printing. The plurality of positioning structures are, but not limited to, a plurality of protruding pin-like elements. A person skilled in the art can manufacture the sole and the plurality of positioning structures provided in the manufacturing method of the present disclosure in a seamlessly integrated manner or manufacture them separately by other known technologies. The plurality of positioning structures are not limited to specific configurations. In another embodiment, the positioning structures can be a plurality of holes.

In the embodiment, the one or the plurality of threads in Step (d) is/are made of, but not limited to, thermoplastic polyurethane (TPU). A person skilled in the art can optionally choose any other known thermoplastic resin to constitute the one or a plurality of threads.

In the embodiment, Step (e) is to, but not limited to, heat up the semi-finished product of the shoe for 1 hour at 180° C. Those skilled in the art can optionally adjust the heating duration and the heating temperature, provided that the one or the plurality of threads is/are at least partially melted. Preferably, in Step (e), the heating temperature is between 100° C.-210° C., and the heating duration is between 1-2 hours.

In the embodiment, a plurality of thread extension parts are interlaced with each other to form an upper portion, which constitutes a foot covering part. The space defined by the sole and the foot covering part is suitable to accommodate and retain a user's foot while the user is walking or doing exercises. However, the present disclosure is not limited to these abovementioned embodiments. For example, as described in Embodiment 4, the plurality of thread extension parts can constitute a strap foot covering part. In another embodiment, the plurality of thread extension parts can constitute a mesh foot covering part.

After the processes of heating up and cooling down described in Step (e) and Step (f) respectively, one or a plurality of threads is/are at least partially bonded together, allowing a strength of the produced shoe structure to be enhanced. Additionally, after the processes of heating up and cooling down described in Steps (e) and Step (f) respectively, the one or the plurality of threads is/are solidified to become a configuration that fits the three-dimensional supporting part. Therefore, the space defined by the sole and the foot covering part will be suitable to accommodate and retain a user's foot while s/he is walking or doing exercises.

Embodiment 6

The shoe manufacturing method of Embodiment 6 is similar to that in Embodiment 5, but between Step (d) and Step (e) further comprises: (d-1) placing the three-dimensional supporting part and the semi-finished product of the shoe into a sealed bag; and (d-2) extracting the air from the sealed bag, allowing the sealed bag to substantially cling to a surface of the semi-finished product of the shoe. Furthermore, the process between Step (f) and Step (g) can further comprise: (f-1) removing the three-dimensional supporting part and the shoe from the sealed bag.

The corresponding features of the embodiment and Embodiment 5 will not be repeated here again.

In comparison to Embodiment 5, the shoe manufacturing method of the embodiment can facilitate one or a plurality of threads attaching to each other more closely through the use of a sealed bag, which substantially clings to the surface of the semi-finished product of the shoe, to improve the bonding level of the one or the plurality of threads with each other after being processed by the heating and cooling processing in Step (e) and Step (f) respectively, to further enhance the structural strength of the produced shoe. In addition, as for the shoe manufacturing method of the embodiment, the sealed bag substantially clings to the surface of the semi-finished product of the shoe, making the one or the plurality of threads and the three-dimensional supporting part attach to each other more closely, to elevate the coupling level of the one or the plurality of threads and the three-dimensional supporting part after being processed by the heating and cooling processing methods in Step (e) and Step (f) respectively. The aforementioned steps enable a space defined by the sole and the foot covering part to be suitable for accommodating and retaining a user's foot while s/he is walking or doing exercises.

After being processed by the heating and cooling processing in Step (e) and Step (f) respectively, one or a plurality of threads is solidified to fit the three-dimensional supporting part and allow the space defined by the sole and the foot covering part to be suitable for accommodating and retaining a user's foot while s/he is walking or doing exercises.

In summary, the shoe of the present disclosure comprises one or a plurality of threads to form a foot covering part, and the manufacturing method thereof requires fewer processing steps, which makes the manufacturing process simpler and eliminates the need for adhesive.

REFERENCE SIGNS

10 shoe
11 sole
12 positioning structure
13 thread extension part
14 upper portion
15 top surface
16 sidewall surface
17 bottom surface
20 shoe
21 sole
22 positioning structure
23 thread extension part
24 upper portion
241 toe box
30 shoe
31 sole
32 positioning structure
33 thread extension part
34 upper portion
40 shoe
41 sole
42 positioning structure
43 thread extension part
44 foot covering part
Step S501
Step S502
Step S503
Step S504
Step S505
Step S506
Step S507

What is claimed is:

1. A shoe, comprising:

a sole having a bottom surface a sidewall surface, and a top surface opposite to the bottom surface;

a plurality of positioning structures integral to the sole and disposed on a perimeter of the sidewall surface at an intersection of the sidewall surface and the top surface, wherein the plurality of positioning structures are a plurality of pin-like elements each having a head portion and an extending portion, the head portion having a larger diameter than the extending portion; and a foot covering part comprising at least one thread, wherein:

each of the at least one thread extends from a first one of the plurality of positioning structures to a second one of the plurality of positioning structures to form a thread extension part, a plurality of the thread extension parts form a configuration that fits a foot of a user, each of the at least one thread has a fineness of 150D to 1500D, each of the at least one thread is wound around at least one of the plurality of positioning structures at least two times, and the sole and the foot covering part define a space suitable to accommodate and retain the foot while the user is walking or doing exercises.

2. The shoe of claim 1, wherein the foot covering part constitutes an upper portion of the shoe.

3. The shoe of claim 2, wherein a thread density at a toe box of the shoe is higher than the thread density at other parts of the shoe.

4. The shoe of claim 2, wherein a thread density at a heel counter of the shoe is higher than the thread density at other parts of the shoe.

5. The shoe of claim 1, wherein a diameter of the head portion of each of the plurality of protruding pin-like elements and a diameter of the extending portion of each of the plurality of protruding pin-like elements, which extends from the head portion to the sole, has a diameter ratio of 1.3 to 2.2.

6. The shoe of claim 1, wherein the plurality of positioning structures are spaced apart from each other by a uniform distance.

7. The shoe of claim 1, wherein the head portion has a diameter of 1.8 mm and a thickness of 1 mm.

8. The shoe of claim 7, wherein the extending portion has a diameter of 1 mm and a length of 2 mm.

9. The shoe of claim 1, wherein the extending portion has a diameter of 1 mm and a length of 2 mm.

10. The shoe of claim 1, wherein the head portion has a diameter of 2.2 mm and a thickness of 1 mm.

11. The shoe of claim 10, wherein the extending portion has a diameter of 1.3 mm and a length of 1.3 mm.

12. The shoe of claim 1, wherein the extending portion has a diameter of 1.3 mm and a length of 1.3 mm.

13. The shoe of claim 1, wherein:

the head portion has a diameter between 1.8 mm and 2.2 mm, and the extending portion has a diameter between 1 mm and 1.3 mm.

14. The shoe of claim 13, wherein the extending portion has a length between 1.3 mm and 2 mm.

15. The shoe of claim 1, wherein the at least one thread comprises thermoplastic polyurethane.

16. The shoe of claim 1, wherein each of the at least one thread is wound around at least one of the plurality of positioning structures at least three times.

17. The shoe of claim 1, wherein the at least one thread is a single thread.

* * * * *